US006223756B1

(12) United States Patent
Schulze-Eyssing

(10) Patent No.: US 6,223,756 B1
(45) Date of Patent: May 1, 2001

(54) APPARATUS FOR DEGREASING SOLID PARTS

(75) Inventor: Heinz Schulze-Eyssing, Dielheim (DE)

(73) Assignee: Turbo-Clean GmbH, Walldorf (DE)

( * ) Notice: Subject to any disclaimer, the term of this patent is extended or adjusted under 35 U.S.C. 154(b) by 0 days.

(21) Appl. No.: 09/282,967

(22) Filed: Mar. 31, 1999

(51) Int. Cl.[7] ..... B08B 3/12

(52) U.S. Cl. ..... 134/95.2; 134/99.1; 134/104.3; 134/121; 134/186; 210/369; 210/378

(58) Field of Search ..... 134/95.1, 95.2, 134/99.1, 104.3, 121, 186; 210/369, 378

(56) References Cited

U.S. PATENT DOCUMENTS 3,302,794 * 2/1967 Laven ..... 210/378 X

FOREIGN PATENT DOCUMENTS 4100414 4/1992 (DE) .
15862 * of 1904 (GB) .
9729853 8/1997 (WO) .

* cited by examiner

*Primary Examiner*—Philip R. Coe
(74) *Attorney, Agent, or Firm*—Horst M. Kasper

(57) ABSTRACT

An apparatus for degreasing solid and/or mass-produced parts, such as small metallic parts comprises a drum with a perforated drum wall rotatable and drivable around a vertical axis. A charge opening is furnished at the top and a discharge opening furnished at the bottom. The discharge opening is closable by an axially movable floor closure. A stationery outer ring channel surrounds the drum and exhibits at the bottom an outer ring trough with discharge port. An inner ring channel is disposed between the outer ring channel and the drum and axially adjustable by way of an adjustment member and including an inner ring trough at the bottom. Feed lines for treatment agent lead into the drum. The inner ring channel is formed adjustable from the starting position, releasing the drum perforations, into a center position covering the drum perforations on the outside, and into a sealing position for sealing the drum.

21 Claims, 1 Drawing Sheet

APPARATUS FOR DEGREASING SOLID PARTS

BACKGROUND OF THE INVENTION

1. Field of the Invention

The invention relates to an apparatus for degreasing of solid parts and of mass-produced parts, such as small metallic parts, comprising a drum with a perforated drum wall rotatable and drivable around a vertical axis, and a charge opening disposed on the top side and a discharge opening disposed at the floor side and closable with an axially movable floor closure, a stationary outer ring channel surrounding the drum and exhibiting at the bottom an outer ring trough with discharge ports, an inner ring channel disposed between the outer ring channel and the drum, axially shiftable with a set member, and including an inner ring trough at the bottom as well as feed lines for treatment agents to be delivered to the drum.

2. Brief Description of the Background of the Invention Including Prior Art

A device of the initially recited kind is already known from the German printed patent document DE-41 00 414 C1. According to the teachings of this reference, the inner ring channel can in fact be moved from a starting position, releasing the drum perforations, into an elevated position covering the drum perforations, however, it is not possible to seal the drum toward the outside. A flooding of the material disposed in the drum as well as the evacuation or the pressurization of the inner space of the drum is therefore not possible. The practicable and feasible treatment methods for the degreasing and drying as well as possibly conserving of solid or mass-produced parts are therefore limited and have to be extended over time until such predetermined effect is being achieved. In addition, a device for the oil impregnation of sintered parts is known from the international printed patent document WO 97/29853 (entry into U.S. national phase under Ser. No. 08/945,285), wherein the drum can be sealed toward the outside in order to flood the parts disposed in the drum and to subject them to an underpressure. The pressure-sealed closure of the drum is thereby performed immediately at the drum, i.e. at the rotatable part. This requires a substantial construction expenditure for the transfer from the stationary casing part to the rotatable drum, such as for example the feeding of treatment liquid or, respectively, the blowing in or the suctioning-off of air. This renders the apparatus extensive in its construction and difficult in its operation.

It is object of the present invention to furnish a method and an apparatus which is or, respectively, are capable to detect simultaneously both groups of gases, namely oxidizable gases as well as reducible gases with one and the same sensor based on metal sensors, such as in particular the known metal oxide sensors.

SUMMARY OF THE INVENTION

1. Purposes of the Invention

It is an object of the present invention to produce a device which is simple in its construction and with which there can be performed a multitude of methods for degreasing and subsequent treatment for a complete degreasing of solid or mass-produced parts.

These and other objects and advantages of the present invention will be come evident from the description which follows.

2. Brief Description of the Invention

According to the present, this object is achieved in that the inner ring channel is formed to be adjustable from a starting position, releasing and freeing the drum perforations, into an intermediate position, covering the drum perforations on the outside, and into a sealing position sealing off the drum.

The advantages associated with and accomplished according to the present invention comprise in particular that now a sealed container is produced by the inner ring channel and the drum, wherein the solid and mass-produced parts can be flooded. The solid or mass-produced parts are thereby intensively subjected to the respective liquid, for example, a degreasing liquid. This process corresponds to a soaking, which substantially facilitates the subsequent dissolving of the oil layer from the precedingly performed deformation method. Independently therefrom, the conventional method steps, such as the spinning off of oil or oil centrifuging, the spraying with the degreasing agents or other treatment agents, and the periodic centrifuging and drying can be performed as required. The apparatus according to the present invention therefore achieves a substantially larger application range as compared to known apparatuses, where the constructive expenditures are relatively low. In this way, the treatment of the parts can be performed more intensively than in the past, such that these parts are transformed into a fat-free state, which corresponds and meets also stringent requirements to an absence of a grease coating or freedom from grease.

An apparatus for degreasing solid and/or mass-produced parts, such as small metallic parts, comprises a drum having a drum floor and having a perforated drum wall furnished with perforations. The drum is rotatable and drivable around a vertical axis. A charge opening is furnished at a top of the drum. An axially movable floor closure is disposed in an area of a bottom of the drum. A discharge opening is furnished at the bottom of the drum. The discharge opening is closable by the axially movable floor closure. A stationery outer ring channel surrounds the drum and exhibits at the bottom an outer ring trough having a discharge port. An inner ring channel is disposed between the outer ring channel and the drum and axially adjustable by way of an adjustment member and includes an inner ring trough at the bottom. The inner ring channel is formed adjustable in position from between a starting position, releasing the drum perforations to be open, a center position covering the drum perforations on the outside, and a sealing position for sealing the drum perforations. Feed lines are leading into the drum for feeding treatment agent into the drum.

The drum floor can be furnished with a turn-out bore. A sealing ring can be furnished at the inner ring trough of the inner ring channel. The sealing ring can be insertable into the turn-out bore in the drum floor.

At least one radial discharge channel can be disposed in the drum floor. The radial discharge channel can join outside to the inner ring channel and inside into a slot disposed between the drum floor and the floor closure.

A first sealing ring can be furnished in the slot between the drum floor and the floor closure. A second sealing ring can be furnished below the radial discharge channel.

A frame can support the drum. A third sealing ring can be furnished at an upper edge of the inner ring channel and rest sealingly at the frame above the drum perforations.

The third sealing ring can be formed as a profile ring with an inner axial sealing face and with an upper radial sealing face for resting at fourth sealing rings of the frame in the sealing position of the inner ring channel and with a lower radial sealing face for resting at a seal at the outer ring channel in the starting position of the inner channel.

An annular plate can be sealingly connected to the fourth sealing rings and be disposed at the frame in an area around the charge opening. Several radial supply channels can be furnished serving as a feed and passing through the annular plates. The several radial supply channels can be closed by respective ones of several valves. The several radial supply channels can join into the drum. At least one of the several radial supply channels can be furnished for feeding in degreasing agent. At least one of the several radial supply channels can be furnished for blowing in compressed air.

A storage funnel can be provided for closing the charge opening. A slider can be furnished below the storage funnel for closing the charge opening. The slider can be formed as a drip pan furnished with a discharge.

The slider can be formed for providing an air-impermeable closure of the charge opening by placement of a fifth sealing ring surrounding the charge opening and supported on the annular plate.

At least one of the several radial supply channels can be furnished for connection to an evacuation device.

A pipe system can form a subframe of the frame. The evacuation device can include an evacuation storage having said pipe system. The pipe system can be furnished with spatially interconnected pipes. An evacuation pump can be connected to the evacuation storage.

At least one ultrasound transducer can be disposed at a floor of the inner ring trough.

A set cylinder can be formed as a two-position cylinder, wherein the inner ring channel can be connected to the set cylinder or the floor closure can be connected to the set cylinder.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the accompanying drawings, in which are shown several of the various possible embodiments of the present invention.

DESCRIPTION OF THE INVENTION AND PREFERRED EMBODIMENTS

Figure 1:
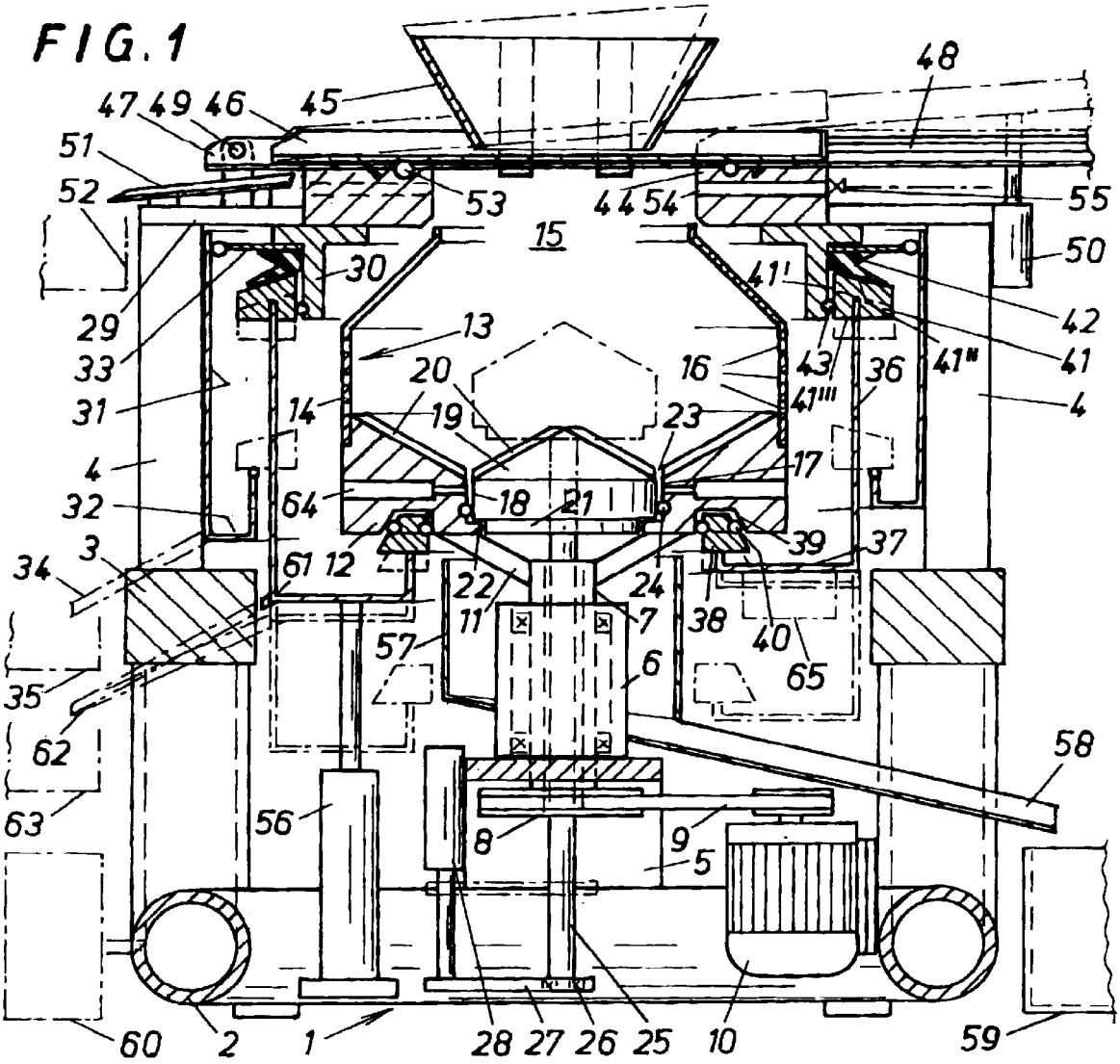
FIG. 1 shows a vertical sectional view through the apparatus.
Figure 2:
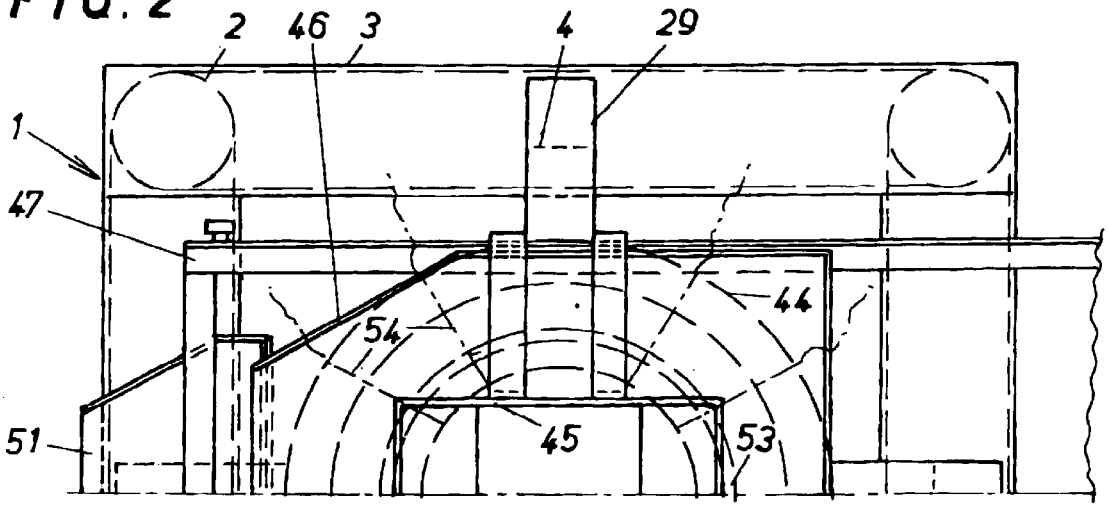
FIG. 2 shows a partial top plan view onto the apparatus.

The present invention provides for an apparatus for degreasing solid and/or mass-produced parts, such as small metallic parts. A drum with a perforated drum wall is rotatable and drivable around a vertical axis. A charge opening is furnished at the top and a discharge opening is furnished at the bottom. The discharge opening is closable by an axially movable floor closure. A stationery outer ring channel surrounds the drum and exhibits at the bottom an outer ring trough with discharge port. An inner ring channel is disposed between the outer ring channel and the drum and is axially adjustable by way of an adjustment member and includes an inner ring trough at the bottom. Feed lines for treatment agent lead into the drum. The inner ring channel 36 is formed adjustable from the starting position, releasing the drum perforations 16, into a center position covering the drum perforations 16 on the outside, and into a sealing position for sealing the drum 13.

The inner ring channel 36 can be furnished at its inner ring trough 37 with a sealing ring 38, insertable into a turn-out bore 39 in the drum floor 12.

At least one radial discharge channel 64 can be disposed in the drum floor 12. The radial discharge channel 64 can join on the outside to the inner ring channel 36 and on the inside into a slot 23 disposed between the drum floor 12 and the floor closure 19. A sealing ring 24 can be furnished in the slot 23 between the drum floor 12 and the floor closure 19 as well as below the discharge channel 64.

A sealing ring 41 can be furnished at the upper edge of the inner ring channel 36 and rest sealingly at the frame 1 above the drum perforation 16. The sealing ring 41 can be formed as a profile ring with an inner axial sealing face 41' and with an upper radial sealing face 41" for resting at the sealing rings 42, 43 of the frame 1 in the sealing position of the inner ring channel 36 and with a lower radial sealing face 41'" for resting at a seal at the outer ring channel 31 in the starting position of the inner channel 36. An annular plate 44, sealingly connected to the sealing rings 42, 43, can be disposed at the frame 1 around the charge opening 15. Several radial supply channels 54 can be furnished serving as a feed and passing through the annular plates 44. The supply channels 54 are closable by valves 55 and can join into the drum 13. At least one of the supply channels 54 can be furnished for feeding in degreasing agent. At least one of the supply channels 54 can be furnished for blowing in compressed air.

A slider 46 can be furnished below the storage funnel 45 for closing the charge opening 15. The slider 46 can be formed as a drip pan furnished with a discharge. The slider 46 can be formed for providing an air-impermeable closure of the charge opening 15 by placement of a sealing ring 53 surrounding the charge opening 15 and supported on the annular plate 44. At least one supply channel 54 can be furnished for connection to an evacuation device. The evacuation device can include an evacuation storage with a pipe system forming the subframe 2 of the frame 1. The pipe system can be furnished with spatially interconnected pipes and with an evacuation pump 60 connected to the evacuation storage.

At least one ultrasound transducer 65 can be disposed at the floor of the inner ring trough 37. The inner ring channel 36 can be connected to a set cylinder 56 formed as a two-position cylinder. The floor closure 19 can be connected to a set cylinder 28, formed as a two-position cylinder.

The apparatus for degreasing solid and/or mass-produced parts, such as small metallic articles of the kind of plain bearing bushes or sintered parts and the like, exhibits a frame 1 with a trapezoidal or square subframe 2, wherein supports are disposed at the corners of the subframe 2 and support a circumferential intermediate frame 3 at about a middle height level of the apparatus. Four columns 4, disposed centered in longitudinal direction and protruding upwardly, rest on the circumferential intermediate frame 3. The subframe 2 includes a circumferentially closed floor part at the bottom, and two oppositely disposed arms of the circumferentially closed floor part are centeredly connected to each other by a bridge 5. A support pipe 6 is seated vertically in the center of the bridge 5, wherein a hollow shaft 7 is rotatably supported in the support pipe 6. The lower end of the hollow shaft 7 protrudes downwardly through a borehole in the bridge 5 and carries there a drive wheel 8, wherein the drive wheel 8 is drivingly connected with a driving means 9, for example a wedge belt (V-belt), to an electric motor 10 attached at the subframe 2. Radial support arms 11 are attached at the upper end of the hollow shaft 7, protruding from the support pipe 6, wherein the drum floor 12 of a drum 13 rests on the radial support arms 11. The drum floor 12 is formed like a truncated cone with an outwardly increasing floor face and carries a cylindrical drum jacket 14, wherein the drum jacket 14 tapers conically at the top on the full wall to a charge opening 15. A drum borehole 16 is furnished at the cylindrical part of the drum jacket 14. The drum floor 12 surrounds a discharge opening 17 with a cylindrical turn-out bore, wherein a floor closure 19 is seated in the discharge opening 17 with an adapted cylindrical outer periphery 18, which floor closure 19 protrudes conically into the drum 13. Dog follower ribs 20 are disposed on the floor closure 19 and on the drum floor 12. A turn-out bore 21 is furnished at the lower end of the outer periphery 18, wherein a ring nose 22 of the discharge opening 17 projects into the turn-out bore 21 for mutual centering. A slot 23 is furnished between the ring nose 22 and the floor closure 19, wherein the slot 23 is sealed downwardly by a sealing ring 24 disposed at the drum floor 12. The floor closure 19 is seated on a pressure rod 25, wherein the pressure rod 25 is led through the hollow shaft 7 and protrudes downwardly. The lower end of the pressure rod 25 is rotatably supported in a horizontal adjustment arm 27 with a pressure bearing 26, wherein the horizontal adjustment arm 27 is connected to a set cylinder 28 attached for example at the bridge 5. The pressure rod 25 can thus be adjusted from the illustrated lower position upwardly into the dash-dotted indicated position. The floor closure 19 is thereby also lifted from the illustrated closure position into the also dash-dotted discharge position.

Radially inwardly protruding support arms 29 are seated on the columns 4, wherein a support ring 30 is attached to the support arms 29 at about the height level of the charge opening 15. Furthermore, an outer ring channel 31, surrounding the drum 13, is attached on the inside at the columns 4, wherein the outer ring channel 31 exhibits approximately the height level of the drum 13 and an outer ring trough 32 protruding inwardly at the bottom. Furthermore, a horizontal flat sheet-metal ring 33 is attached at the support ring 30, wherein the horizontal flat sheet-metal ring 33 rests with a seal at the outer ring channel 31. The outer ring trough 32 is disposed inclined in its course and exhibits a flow discharge port 34 at the lowest point, wherein the flow discharge port 34 ends outside above a collection container 35. The collection container 35 and the flow discharge port 34 can be disposed as a function of the location of installation and are therefore indicated by dash-dotted lines. An axially adjustable inner ring channel 36 is furnished between the outer ring channel 31 and the drum 13, wherein the axially adjustable inner ring channel 36 is formed at its lower end also as an inwardly projecting inner ring trough 37 and is slidable by a set cylinder 56 supported at the frame 1. The inner ring trough 37 protrudes up to under the drum floor 12 and carries there a sealing ring 38, formed for example of a trapezoidal shape and directed against the drum floor 12. An adapted turn-out bore 39 in the drum floor 12 is coordinated to the trapezoidally formed sealing ring 38. Sealing rings 40 disposed on two sides of the sealing ring 38 serve to seal. The inner ring channel 36 protrudes up to the height level of the support ring 30 in the illustrated sealing position, wherein the inner ring channel 36 presses a sealing ring 41, applied to a front face, with its radial sealing face 41", furnished on the top, against a sealing ring 42 attached at the support ring 30 and the sheet-metal ring 33. A further sealing ring 43 is disposed at the support ring 30, wherein the support ring 30 rests on the inside at the sealing ring 41 at an axial sealing face 41'.

A ring plate 44, surrounding the charge opening, rests on the support ring 30, wherein a storage funnel 45 for the batch storing and charging of the drum 13 through the charge opening 15 is positioned over the central opening of the ring plate 44 spanning over the charge opening 15. A slider 46 serves for closing the lower opening of the storage funnel 45, wherein the slider 46 is longitudinally guided in a longitudinal guide 47 supporting the storage funnel 45. The slider 46 is formed as a one-side open trough. The slider 46 is adjusted from the illustrated closure position into the dash-dotted indicated open position by an adjustment means 48, for example a set cylinder. In order to catch the oil dripping from the solid parts during the storage, the longitudinal guide 47 is swivellable upwardly around a frame-fixed or frame-stationary rotation point 49 and the longitudinal guide 47 can thus be lifted from the illustrated charging position into a dash-dotted indicated inclined position by a set cylinder 50 also disposed stationary relative to the frame. The oil, dripped off and flowing between the storage funnel 45 and the slider 46, flows in the dash-dotted indicated inclined position into a catch groove 51 and from the catch groove 51 into a collection container 52. The oil collected here and after the centrifuging can be re-employed immediately, possibly after a cleaning for filtering out chips.

The slider 46 is formed as wide as the outer diameter of the ring plate 44 in case a sealed closure of the charge opening 15 is to be accomplished. Annular seals 53 are disposed on the ring plate 44, wherein the annular seals 53 rest at the slider 46 at the bottom in the closure position and thereby sealingly close the interior of the drum. Radial supply channels 54 are led through the ring plate 44 for the feeding of treatment agents, such as for example degreasing liquid, compressed air or other treatment liquids, wherein the radial supply channels 54 are closable by valves 55, and wherein the suppliers of the treatment agents are connected to the radial supply channels 54. A catch ring 57 is disposed fixed relative to the frame and below the discharge opening 17, wherein the catch ring 57 joins a chute 58, wherein the chute 58 leads to the outside and ends over a container 59 for catching the degreased parts.

According to the present invention, the set cylinder 56 is formed as a two-position cylinder. Thus, the inner ring channel 36 can be lifted from the lower dash-dotted illustrated starting position, in which the sealing ring 41 rests with its lower radial sealing face 41'" on an annular seal at the outer ring trough 32, into the first position, also indicated with dash-dotted lines, of the center position. The sealing ring 38 is still disposed outside of the turn-out bore 39 in the drum floor 12 when in the center position, while the sealing ring 41 rests already at the annular seal 43 of the support ring 30. The drum 13 thus can freely rotate in the center position of the inner ring channel 36. The inner ring channel 36 passes into its sealing position based on a renewed lifting into the second position, in which both the sealing ring 38 with its sealing rings 40 in the turn-out bore 39 as well as the sealing ring 41 with its upper sealing face 41" rest at the sealing ring 42. The drum 13 is thereby sealed on the side and downwardly. If the charge opening 15 is also to be sealed, then the annular seals 53 are furnished on the ring plate 44, wherein the slider 46, possibly with the aid of the set cylinder 50, is pressed against the annular seals 53. If the drum 13 is furthermore to be evacuated, then an evacuation device with an evacuation pump 60 is furnished. The evacuation pump 60 is connected to an evacuation storage, wherein the evacuation storage in turn is connected to one or several supply channels 54. The subframe 2 is formed as an evacuation storage according to the present invention and therefore comprises spatially interconnected pipes, wherein the evacuation pump 60 is connected to the spatially interconnected pipes. The evacuation pump 60 can be arranged, as illustrated, outside of the apparatus or also integrated into the apparatus.

According to the method, the solid and/or mass-produced parts can be centrifuged after the charging into the drum 13 if the inner ring channel 36 is disposed in starting position, wherein the oil flows from the outer ring channel 31 through the discharge port 34 into the collection container 35. Then, the inner ring channel 36 is brought into the center position and the degreasing liquid is sprayed into the drum 13 through the supply channels 54 connected to the supplier for the degreasing liquid and are thereby subjected to a periodical centrifuging, such that the solid or mass-produced parts are rearranged several times and thereby assume different positions. Finally, compressed air at room temperature or also heated is blown in through different supply channels 54 for drying purposes, wherein the drum 13 is again subjected to a periodical rotation. The drying can further be supported by a slight lifting of the floor closure 19 above the sealing ring 24, wherein air flows downwardly from the drum 13 through the generated intermediate gap. This process is further supported by the formation of the support arms 11 as propeller wings. The inner ring channel 36 can be disposed in the center position or in the sealing position in this method. Advantageously, the frame 1 is surrounded by an about sealed casing such that the drying air flowing out of the drum 13 can be suctioned off and discharged. The set cylinder 28 for the floor closure 19 is formed as a two-position cylinder according to this embodiment. An unloading in downward direction occurs after the drying by lifting the floor closure 19, and the parts are collected in the container 59.

According to the present invention, this method can also be expanded by moving the inner ring channel 36 into the sealing position after centrifuging the oil and by filling degreasing liquid into the drum 13 through the coordinated supply channels 54 until all parts in the drum 13 are flooded. This soaking occurs while the drum 13 is in its rest position. After a soaking time, depending on the kind of the parts and the oil to be removed, a valve disposed at the discharge port 61 of the inner ring channel 36 is opened such that the degreasing liquid mixed with the oil flows through a discharge pipe 62 into a catch container 63. As soon as degreasing liquid remains only in the inner ring trough 37, the inner ring channel 36 is lowered into the center position and the drum 13 is rotated. Thereby, degreasing liquid flows into the inner ring trough 37 through radial discharge channels 64 disposed horizontally in the drum floor 12. The discharge channels 64 join on the inside into the slot 23, disposed between the floor closure 19 and the drum floor 12, and in fact above the sealing ring 24. This degreasing liquid also flows through the discharge pipe 62 into the catch container 63 or through a separate discharge pipe into a different catch container. Depending on the degree of oil concentration of the degreasing liquid, the mixtures can be collected separately. A discharge in downward direction is performed by lifting the floor closure 19 after the drying. The parts are collected in the container 59.

An additional evacuation can be performed during the soaking phase after flooding the solid or mass-produced parts with the degreasing liquid according to a further embodiment of the invention, whereby degassing is intensified and the interaction of the degreasing liquid with the oil film is intensified. The inner ring channel 36 and the slider 46 are in this case disposed in their sealing positions. The evacuation is performed very rapidly, since the evacuation storage is constantly maintained ventilated and the air is thus promptly suctioned from the inner chamber after opening the valves. After termination of the soaking phase, the subsequent discharge of the degreasing liquid can be accelerated further by blowing in compressed air and the thereby generated overpressure.

In addition, a second axially adjustable ring channel can be furnished in the drum 13, if, for example, particular liquids are employed for conservation purposes, which particular liquids are to be collected separately. The cleaning of the solid and/or mass-produced parts during the soaking phase can be increased still further based on ultrasound transducers 65, attached outside at the inner ring trough 37.

According to a further embodiment of the invention, a sliding ring seal can be disposed between the sealing ring 38 and the inner ring trough 37, wherein the sliding ring seal for example can assume the shape of a sealed ball bearing, such that centrifugation can also be performed during the evacuation phase, wherein the sealing ring 38 rotates together with the drum 13.

It can be recognized that the apparatus for the degreasing of solid and/or mass-produced parts according to the present invention can be applied to a series of different treatment methods. For example, the suitable cleaning process can be selected depending on the structure of the parts and depending on the wetting parameters of the oil. The parts are subjected to high-grade cleaning in an automatically running process such that the parts can be fed immediately to the respective sequential employment.

According to the invention, the axis of the drum 13 and the parts of the apparatus associated therewith alternatively can also be disposed in an axial direction deviating from a vertical axial direction, i.e. in an inclined or sloped axial direction extending up to a horizontal axial direction.

It will be understood that each of the elements described above, or two or more together, may also find a useful application in other methods and types of devices for degreasing solid and/or mass-produced parts differing from the types described above.

While the invention has been illustrated and described as embodied in the context of a method and apparatus for a degreasing of solid parts such as small metallic parts, it is not intended to be limited to the details shown, since the various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

What is claimed is:

1. An apparatus for degreasing solid and/or mass-produced parts comprising a drum having a drum floor and having a perforated drum wall furnished with perforations, wherein the drum is rotatable and drivable around a vertical axis;

a charge opening furnished at a top of the drum;

an axially movable floor closure disposed in an area of the drum floor;

a discharge opening furnished at the drum floor, wherein the discharge opening is closable by the axially movable floor closure;

a stationery outer ring channel having a bottom and surrounding the drum and including at the bottom an outer ring trough having a discharge port;

an adjustment member;

an inner ring channel disposed between the outer ring channel and the drum and axially adjustable by way of the adjustment member and including an inner ring trough at a bottom of the inner ring channel, wherein the inner ring channel is formed adjustable in position from a starting position, wherein the drum perforations to be open and uncovered into a center position, wherein the drum perforations are covered, and into a sealing position;

wherein the drum is sealed; and feed lines leading into the drum for feeding treatment agent into the drum.

2. The apparatus according to claim 1, wherein the drum floor is furnished with a turn-out bore; further comprising a sealing ring furnished at the inner ring trough of the inner ring channel, wherein the sealing ring is insertable into the bore in the drum floor.

3. The apparatus according to claim 1, further comprising at least one radial discharge channel disposed in the drum floor, wherein the radial discharge channel joins at its outside to the inner ring channel and at its inside into a slot disposed between the drum floor and the floor closure.

4. The apparatus according to claim 3, further comprising a first sealing ring furnished in the slot between the drum floor and the floor closure;

a second sealing ring furnished below the radial discharge channel.

5. The apparatus according to claim 1, further comprising a frame supporting the drum;

a third sealing ring furnished at an upper edge of the inner ring channel and resting sealingly at the frame above the drum perforations.

6. The apparatus according to claim 5, further comprising fourth sealing rings of the frame, wherein the third sealing ring is formed as a profile ring with an inner axial sealing face and with an upper radial sealing face for resting at the fourth sealing rings of the frame in the sealing position of the inner ring channel and with a lower radial sealing face for resting at a seal at the outer ring channel in the starting position of the inner channel.

7. The apparatus according to claim 6, further comprising an annular plate, wherein the annular plate is sealingly connected to the fourth sealing rings and is disposed at the frame in an area around the charge opening;

several valves;

several radial supply channels, wherein the several radial supply channels are furnished serving as a feed and passing through the annular plates, wherein the several radial supply channels are closable by respective ones of the several valves, and wherein the several radial supply channels join into the drum, wherein at least one of the several radial supply channels is furnished for feeding in degreasing agent, and wherein at least one of the several radial supply channels is furnished for blowing in compressed air.

8. The apparatus according to claim 7, further comprising a storage funnel for closing the charge opening;

a slider, wherein the slider is furnished below the storage funnel for closing the charge opening, wherein the slider is formed as a drip pan furnished with a discharge.

9. The apparatus according to claim 8, wherein the slider is formed for providing an air-impermeable closure of the charge opening by placement of a fifth sealing ring surrounding the charge opening and supported on the annular plate.

10. The apparatus according to claim 8, wherein at least one of the several radial supply channels is furnished for connection to an evacuation device.

11. The apparatus according to claim 10, further comprising a pipe system forming a subframe of the frame, wherein the evacuation device includes an evacuation storage having said pipe system, wherein the pipe system is furnished with spatially interconnected pipes; and an evacuation pump connected to the evacuation storage.

12. The apparatus according to claim 1, further comprising at least one ultrasound transducer disposed at a floor of the inner ring trough.

13. The apparatus according to claim 1, further comprising a set cylinder formed as a two-position cylinder, wherein the inner ring channel is connected to the set cylinder.

14. The apparatus according to claim 1, further comprising a set cylinder formed as a two-position cylinder, wherein the floor closure is connected to the set cylinder.

15. An apparatus for degreasing solid and/or mass-produced parts comprising a drum with a perforated drum wall rotatable and drivable around a vertical axis, a charge opening furnished at the top, a discharge opening furnished at a drum floor, wherein the discharge opening is closable by an axially movable floor closure, a stationery outer ring channel having a bottom and surrounding the drum and exhibiting at the bottom an outer ring trough with discharge port, an inner ring channel disposed between the outer ring channel and the drum and axially adjustable by way of an adjustment member and including an inner ring trough at a bottom of the inner ring channel and feed lines for treatment agent leading into the drum, wherein the inner ring channel (36) is formed adjustable from the starting position, releasing the drum perforations (16) uncovered, into a center position wherein the drum perforations (16) are covered on the outside, and into a sealing position for sealing the drum (13).

16. The apparatus according to claim 15, wherein the inner ring channel (36) is furnished at its inner ring trough (37) with a sealing ring (38), insertable into a bore (39) in the drum floor (12).

17. The apparatus according to claim 16, wherein the sealing ring (38) is supported on the inner ring trough (37) with a slide ring seal.

18. The apparatus according to claim 15, wherein at least one radial discharge channel (64) is disposed in the drum floor (12), wherein the radial discharge channel (64) joins at its outside to the inner ring channel (36) and at its inside into a slot (23) disposed between the drum floor (12) and the floor closure (19);

wherein a sealing ring (24) is furnished in the slot (23) between the drum floor (12) and the floor closure (19) as well as below the discharge channel (64).

19. The apparatus according to claim 15, wherein a sealing ring (41) is furnished at the upper edge of the inner ring channel (36) and resting sealingly at the frame (1) above the drum perforation (16);

wherein the sealing ring (41) is formed as a profile ring with an inner axial sealing face (41') and with an upper radial sealing face (41") for resting at the sealing rings (42, 43) of the frame (1) in the sealing position of the inner ring channel (36) and with a lower radial sealing face (41'") for resting at a seal at the outer ring channel (31) in the starting position of the inner channel (36);

wherein an annular plate (44), sealingly connected to the sealing rings (42, 43), is disposed at the frame (1) around the charge opening (15), and wherein several radial supply channels (54) are furnished serving as a feed and passing through the annular plates (44), wherein the supply channels (54) are closable by valves (55) and join into the drum (13), wherein at least one of the supply channels (54) is furnished for feeding in degreasing agent, and wherein at least one of the supply channels (54) is furnished for blowing in compressed air.

20. The apparatus according to claim 15, wherein a slider (46) is furnished below the storage funnel (45) for closing the charge opening (15), wherein the slider (46) is formed as a drip pan furnished with a discharge;

wherein the slider (46) is formed for providing an air-impermeable closure of the charge opening (15) by placement of a sealing ring (53) surrounding the charge opening (15) and supported on the annular plate (44);

wherein at least one supply channel (54) is furnished for connection to an evacuation device;

wherein the evacuation device includes an evacuation storage with a pipe system forming the subframe (2) of the frame (1), wherein the pipe system is furnished with spatially interconnected pipes and with an evacuation pump (60) connected to the evacuation storage.

21. The apparatus according to claim 15, wherein at least one ultrasound transducer (65) is disposed at the floor of the inner ring trough (37);

wherein the inner ring channel (36) is connected to a set cylinder (56) formed as a two-position cylinder;

wherein the floor closure (19) is connected to a set cylinder (28), formed as a two-position cylinder.

* * * * *